US006125865A

United States Patent [19]

Bacon Cochrane et al.

[11] Patent Number: 6,125,865

[45] Date of Patent: Oct. 3, 2000

[54] DESANDING SYSTEM FOR OIL TANKS

[75] Inventors: Diana L. Bacon Cochrane; Patrick J. Cochrane, both of Sherwood Park; Wade R. Bozak, Edmonton, all of Canada

[73] Assignee: Canadian Environmental Equipment & Engineering Technologies, Inc., Edmonton, Canada

[21] Appl. No.: 09/028,905

[22] Filed: Feb. 24, 1998

[51] Int. Cl.[7] ..... B08B 3/02

[52] U.S. Cl. ..... 134/169 R; 134/186; 134/198; 134/199

[58] Field of Search ..... 134/94.1, 96.1, 134/98.1, 99.1, 166 R, 167 R, 186, 168 R, 169 R, 171, 198, 199; 15/302, 320; 210/253

[56] References Cited

U.S. PATENT DOCUMENTS

| | | | |
|---|---|---|---|
| 1,559,727 | 11/1925 | Merseles | 134/186 |
| 3,011,769 | 12/1961 | Umbricht | 134/169 R |
| 3,479,679 | 11/1969 | Vogel | 15/302 |
| 3,672,512 | 6/1972 | Werner . | |
| 4,024,881 | 5/1977 | Weiland et al. . | |
| 4,041,965 | 8/1977 | Rosenberg . | |
| 4,212,088 | 7/1980 | Goettl . | |
| 4,466,154 | 8/1984 | Urbani | 15/302 |
| 4,530,131 | 7/1985 | Zell et al. . | |
| 4,714,053 | 12/1987 | Perry | 122/382 |
| 4,913,819 | 4/1990 | Patterson . | |
| 5,073,258 | 12/1991 | Boullain, II et al. . | |
| 5,087,294 | 2/1992 | Rechtzigel | 134/22.1 |
| 5,131,419 | 7/1992 | Roberts | 134/50 |
| 5,135,579 | 8/1992 | Goettl . | |
| 5,346,101 | 9/1994 | Hargis et al. . | |
| 5,413,808 | 5/1995 | Wyner | 427/140 |
| 5,499,640 | 3/1996 | Kirkland | 134/56 D |
| 5,547,514 | 8/1996 | Ward | 134/22.1 |
| 5,582,652 | 12/1996 | Robertson | 134/22.12 |
| 5,613,510 | 3/1997 | Proctor . | |
| 5,720,307 | 2/1998 | Engelking | 134/56 R |
| 5,740,821 | 4/1998 | Arnold . | |
| 5,820,694 | 10/1998 | St. Martin | 134/25.3 |

OTHER PUBLICATIONS

WIPO 81/01372 Svensson 210/523, May 1981.

*Primary Examiner*—Frankie L. Stinson
*Attorney, Agent, or Firm*—Swanson & Bratschun, L.L.C.

[57] ABSTRACT

A particulate removal system has for its purpose to remove settled material from vessels and tanks such as those common to the petroleum industry. The system comprises means of suspending settled particulate material and evacuating the material in such a manner so as not to disturb overlying liquid layers.

2 Claims, 3 Drawing Sheets

13
38
36
12
48
46
44
42
50
56
10
24
22
34
30
54
26
62
52
28
56
18
16
54
52
58
30
32
14

DESANDING SYSTEM FOR OIL TANKS

FIELD OF THE INVENTION

This invention relates to the evacuation of settled solid materials from the base of field storage tanks particularly used in the oil industry and vessels used in heavy chemical downstream processing of particularly heavy crude oil processing.

BACKGROUND OF THE INVENTION

An example of where the invention is particularly useful is in the mining oily sands, such as those found in Alberta, Canada, for the production of hydrocarbon fuels. Inevitably, during processing of these oily sands, an accumulation of solid material develops at the bottom of "in the field" storage tanks (field tanks) as well as at the bottom of intermediate production sand processing vessels. This results in a gradual decrease in the available volume of the tanks and vessels. The present method for removing settled material from field tanks involves using a water tuck, pressure truck, vacuum truck and stinger crew. Problems with the present method are that it is operationally demanding, equipment intensive, costly, and inefficient with respect to the removal of other materials other than the settled material. A safer, more cost-effective means of removing settled material has long been a goal of the industry. The present invention addresses these problems. The need for a pressure truck and a singer crew is avoided.

SUMMARY OF THE INVENTION

A vessel, particularly a tank such as those used in the oil industry, having a particulate removal system is provided. The particulate removal system evacuates settled particulate matter from the bottom of the vessel in a sequential manner via a process designed to remove the matter without appreciably or excessively disturbing overlying liquid layers.

A particulate removal system for removing settled particulates such as sand intermixed with crude oil from a crude oil holding tank includes an apparatus sequentially controlling water supply to an inner loop manifold and an outer loop manifold which are both centrally located about a vertical axis of said tank to promote movement of settled particulate material toward an open unobstructed inlet of a jet pump. The jet pump aspirates disturbed particulate material through the unobstructed inlet and transports such material outside of the tank. The water supply is sequentially controlled by the apparatus to only supply water to the inner manifold to promote flow of particulate material from a central area to the intake, to terminate the supply of water to the inner manifold and only to supply water to the outer manifold to promote flow of particulate material from an outer area and toward the central area, to terminate the supply of water to said outer manifold and to only supply water to said inner manifold to promote flow of particulate material which has been moved from said outer region toward said unobstructed inlet. The sequence of switching water supply from the inner manifold to the outer manifold is repeated as many times as needed to remove settled particulate material from said tank base. The apparatus controls the flow rate and pressure to each of the manifolds to promote the flow of the sand without excessively or appreciably disturbing the upper fluid layers of crude oil and water.

The suction device for the tank may include a jet pump. The jet pump may be located outside the tank and an intake conduit may extend from the jet pump to within the tank and have its intake port stationed centrally of the tank base. The tank base may be generally flat or it may be a converging tapered base having the jet pump stationed in the converging tapered base area with the jet pump intake located lowermost in the tapered base and the inner and outer manifolds located centrally in the base with the inner manifold being below the outer manifold. An intermediate manifold may be positioned between the inner and outer manifolds.

In a preferred embodiment, the separate water supply means switches the supply of pressurized water between the inner and outer manifolds while removing disturbed particulate material through the suction device. The water supply means develops sufficient pressure to fluidize settled particulate matter without disturbing upper separated oil layer.

BRIEF DESCRIPTION OF THE DRAWINGS

Several aspects of the invention are illustrated in the accompanying drawings, in which like numerals denote like parts throughout the several views, and in which.

DETAILED DESCRIPTION OF THE PREFERRED EMBODIMENTS

The present invention deals generally with the process of removing hydrocarbons and salts from oily sands such as those typically found in heavy oil sands of Alberta, Canada. The oily sand goes through a series of treatment steps until it is eventually separated into its slop oil emulsion, water and solid materials fractions. Either in the field or during processing steps, solid materials settle and accumulate on the bottom of the tank and limit the effective volume of the tank for storage of oil to be treated or production sands. Traditionally, it has been necessary to remove the fluids from the tank and physically get in and shovel out the settled material. Thus the tank could not be used in a continuous manner to achieve storage of an optimal amount of oil. By removing the solid material in a manner which is commercially practicable, increased cost efficiency can be achieved. Once the settled material is removed, additional volumes can be processed. The current invention solves the problem of removing settled material from the bottom of tanks without agitating the oil and water layers and provides a method wherein it is not necessary to shut down the operation to clean the tanks. This invention may be applied to primary storage tanks used in the field or to other sequential processing tanks that accumulate solid material. Although the invention is illustrated with respect to the oil industry, aspects of the invention may be applicable to any situation here it is desirable to remove settled materials without disturbing an overlying fluid layer.

Figure 1:
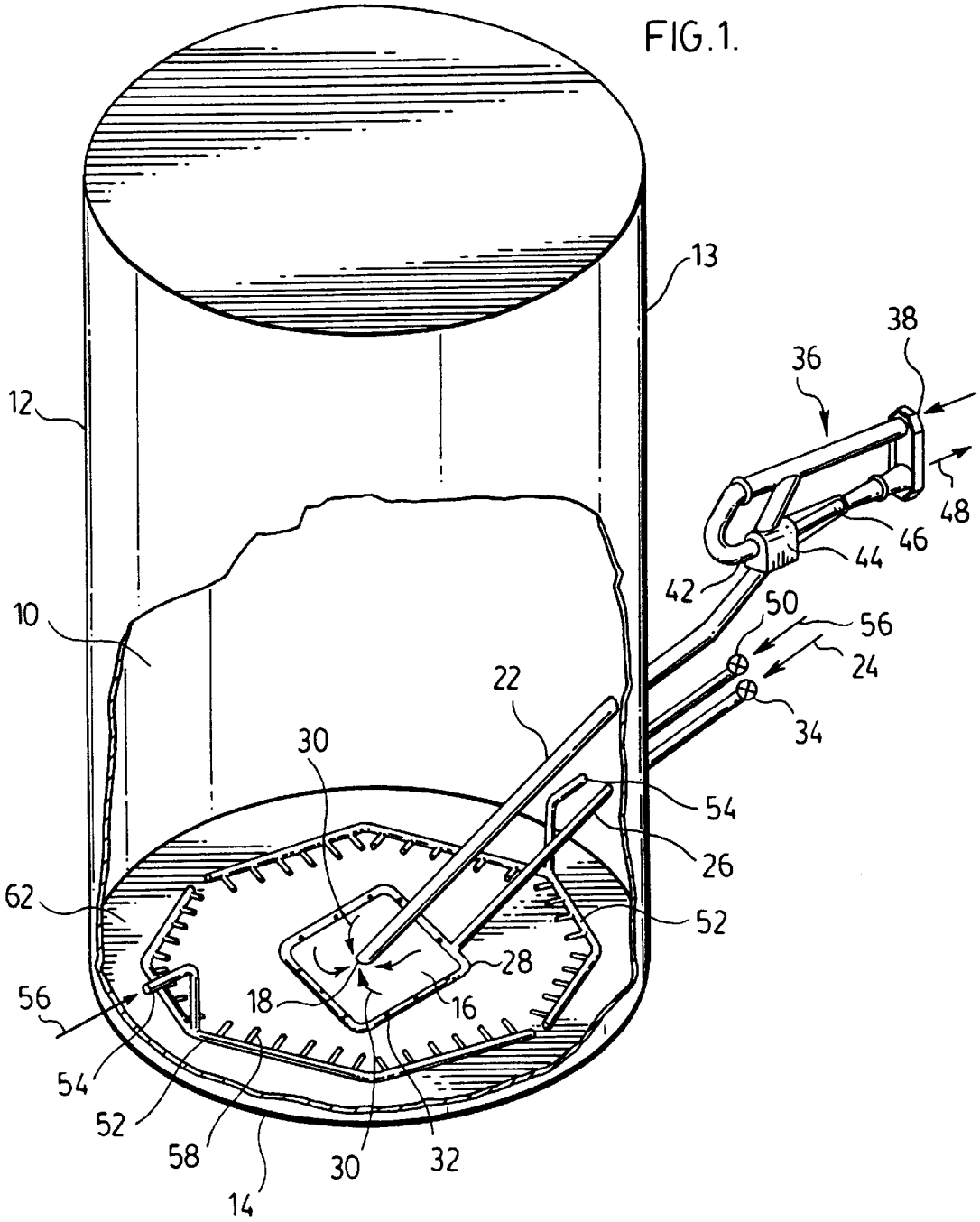
FIG. 1 is a perspective view, partially cut away, of a storage tank having an essentially flat bottom.

In one aspect of the invention, an apparatus for removal of settled material from flat-bottomed circular tanks and a method for its use are provided. In a preferred embodiment, a tank desanding system is applied to a circular tank having a capacity size of less than 1500 barrels. Referring to FIG. 1, settled material 10 accumulates at the bottom of the tank 12. The tank 12 has upright walls 13 and a flat circular bottom 14. The method of desanding generally involves applying low velocity water to the settled material such that it becomes suspended and is thereby evacuated without excessively or appreciably disturbing the upper fluid layers. Once suspended, the central portion 16 of the settled material 10 is evacuated into a suction port 18 and aspirated through a suction manifold 22. The supplied water 24 is typically low pressure and high volume. The water 24 enters the tank via an inlet pipe 26. A valve 34 controls the on/off, pressure and volume of water being supplied. Typically, the minimum flow rate and pressure shall be 100 US gallons per minute and 125 psi, respectively. The flow rate and pressure and are sufficient to suspend and stir up the settled material particles, but not disturb appreciably the upper liquid layers.

In a preferred embodiment there is a center manifold 28 which may be generally rectangular in shape and outer manifolds 52 which form a substantially circular pattern around the perimeter of the tank. However, it is understood that the shape and configuration of the manifolds may vary. The water from inlet pipe 26 supplies a center manifold 28 which has a series of discharge nozzles 32 which are directed generally upwards and through which the water enters the tank. The input water flowing into the settled material 16 via the discharge nozzles 32 causes the sand particles to become dispersed within the water. This sand and water suspension is then aspirated in the direction of arrows 30 from the tank via the suction port 18 and the suction manifold 22. Negative pressure within the suction manifold may be provided by various means such as, for example, rotary or reciprocating pumps, a sliding vane pump, a rotary piston pump, a rotary compressor, a diffusion pump or an ejector type device. In a preferred embodiment, a jet pump 36 is provided. Motive water 38 enters the jet pump 36 and is propelled through the jet nozzle 42 to form a jet stream within the enclosure 44. The jet pump 36 is in communication with the suction manifold 22 to evacuate the sand and water suspension from the tank 12. The sand and water emulsion is propelled though a mixing chamber 46 and the sand is dispelled from the jet pump in the direction of arrow 48. This process continues until the settled material is removed from the center of the tank. The length of time required to remove the central settled material is proportionate to the depth of accumulated material. For example, it typically takes at least 15 minutes to remove centrally settled material that has a depth of three feet.

Once the material has been removed from the center of the tank, the water supply 24 to the center manifold 28 is typically shut off and water 56 is supplied to the outer manifolds 52 via inlet pipes 54. However, there may be situations where it is desirable to supply water to all the manifolds at the same time. A valve 50 controls the pressure and volume of the supplied water 56. The outer manifolds 52 are provided with discharge nozzles 58 that are directed generally towards the center of the tank. As with the center manifold 28, the water is supplied at a minimum velocity of about 100 US gallons per minute and about 125 psi, although these parameters may vary. The purpose of the outer manifolds 52 is to facilitate the removal of material that has settled around the perimeter 62 of the tank 12. As the water is discharged through the nozzles 58, the settled material is suspended and simultaneously pushed towards the center where it is evacuated through the suction port as previously described. The amount of time required to remove the settled material from the perimeter of the tank is once again proportionate to the depth of accumulated solids. It typically takes about 15 minutes to remove three feet of settled material which greatly reduces tank treatment compared to the prior art.

An important aspect of this invention is that the process is able to remove the settled material without appreciably or excessively disturbing the water and oil layers on top. This is accomplished through the suspension of settled material particles in water, followed by evacuation of the slurry from the tank. Several parameters including the configuration of the manifolds as well as the velocity of the water and the rate of evacuation are selected to ensure that 1) the material is adequately suspended for suction without being propelled at a velocity so great that the particles will disrupt the water and/or oil surface, 2) material is removed in a multi-stage sequential manner that is least likely to be disruptive (i.e. the center portion is evacuated initially followed by the perimeter) and 3) the suction is applied at a rate sufficient to effectively evacuate the solid material without applying undue negative forces on the water and oil layers. Because it is not necessary to empty the tank for desanding, additional material can be processed. In addition, because it is not necessary to assign employees the task of entering the tank and removing the solid material, this invention affords safety and timeline advantages and provides for a more efficient utilization of equipment and manpower. In accordance with this invention, the system may be operated on an intermittent maimer to remove solids without having shut down tank operation. In the usual manner, the oil layer and slop oil may be removed from the tank top.

Figure 2:
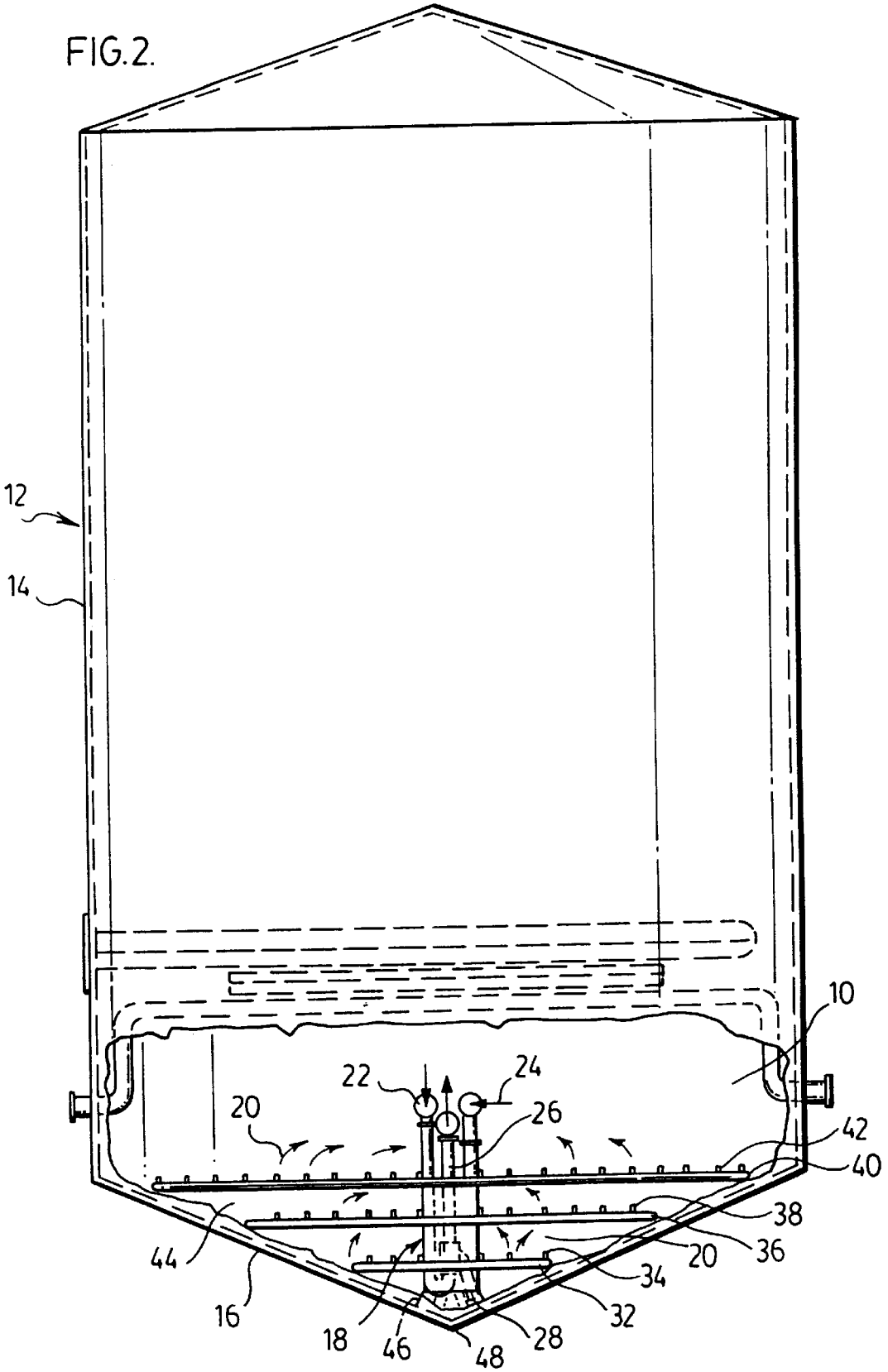
FIG. 2 is a cross-sectional view of a storage tank having a converging sloped bottom and FIG. 3 is a perspective, cut away view of the storage tank of FIG. 2.
Figure 3:
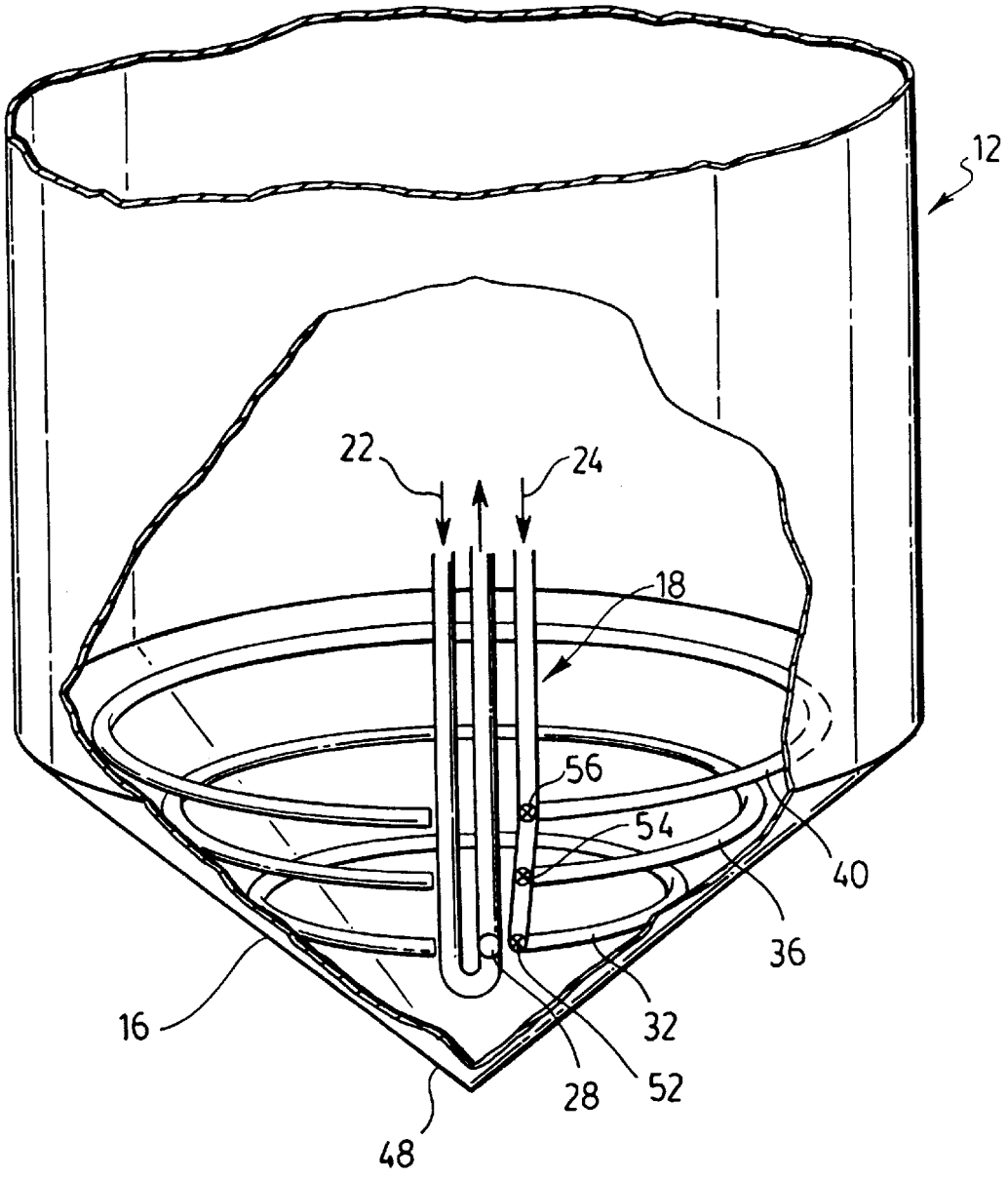

In another aspect of the invention, an apparatus and process for the removal of settled material 10 from tanks having a capacity of about 1500 to about 2000 barrels is provided. Referring to FIG. 2, the tank 12 has upright sides 14 and a converging sloped bottom 16. A suction device for removal of the solid material is also provided. As stated above, the suction can be furnished by a variety of devices, however, this type of tank is more suited to an ejector device. In a preferred embodiment, a jet pump generally indicated at 18 is internally mounted in the converging section of the base. Desanding of these tanks generally follows three stages of suspension of the settled material 10. The process typically involves the utilization of three manifolds, an inner manifold 32, an intermediate manifold 36 and an outer manifold 40. In the primary operation, water is supplied to the inner manifold 32. Dispersal supply water 20 and motive water 22 are pumped into the jet pump 18. The settled material closest to the center of the tank is suspended by water 20 exiting the inner manifold 32 through discharging nozzles 34. The water and sand suspension is aspirated through a suction port 28 and is then pumped out by the jet pump 18 as a slurry. The length of time required to remove the settled material at the center depends upon the depth of the accumulated material. For example, it typically takes only a minimum of 20 minutes to remove center accumulated material having a depth of three feet. Once the settled material has been removed from the center of the tank, then water 20 is supplied, as described above for the inner manifold 32, to the intermediate manifold 36 and discharged through nozzles 38. This results in the simultaneous suspension and propulsion towards the center of settled material around the perimeter of the intermediate portion 44 of the converging tapered bottom and through an area of equivalent diameter. The suspended material is then aspirated through the suction port 28 and through the jet pump 18 as described above. When this operation is complete, the water supply to the intermediate manifold is terminated and water is supplied to the outer manifold 40, in the manner described above for the inner 32 and intermediate 36 manifolds, and is discharged through nozzles 42. The settled material accumulated around the perimeter is simultaneously dispersed and propelled towards the center where it is aspirated into the suction port 28 and evacuated via the jet pump 18. The water required for suspension is supplied through the various manifolds at least a minimum velocity of 120 US gallons per minute and 125 psi. The velocity shall be sufficient to suspend and stir up the particles adequately for their removal without appreciably disturbing the upper layers. The supply of water to the various manifolds is controlled through a series of valves as illustrated with respect to FIG. 3. A valve 52 controls the flow of water to the inner manifold 32, another valve 54 controls the flow to the intermediate manifold 36 and an additional valve 56 controls the flow to the outer manifold 40. It is clearly apparent to one skilled in the art that the number and configuration of manifolds may vary and that each manifold is provided with a control valve. In a preferred embodiment, the valves 52, 54 and 56 are solenoid controlled valves. The valves 52, 54 and 56 are in communication, via suitable electric wiring or remote control means for example, with a process controller which is programmed to open and shut the valves to provide for the sequential operation of the manifolds.

While it is typical that water is supplied to one manifold at a time beginning with the inner manifold 32, it is understood that water may be supplied to more than one manifold at the same time. Additional water spray 46 is supplied through inlet tubes to gently displace the settled material at the apex 48 of the converging tapered bottom section 16. The length of time required to remove the settled material is proportionate to the depth of accumulated material. It should be apparently clear to one skilled in the art that these types of systems described in FIGS. 1 and 2 as well as being applied in the oil industry can be used in any situation where it is desirable to separate solid material from a liquid slurry. Likewise it is clear that the number and arrangement of the discharging manifolds may vary as well as the angle of direction of the nozzles.

Although preferred embodiments of the invention have been described herein in detail, it will be understood by those skilled in the art that variations may be made thereto with departing from the spirit of the invention or the scope of the appended claims.

What is claimed is:

1. A tank for holding oily substances intermixed with particulate matter which particulate matter settles on tank base, said tank having a settled particulate removal system adjacent tank base, said settled particulate removal system comprising:

i) means for sequentially controlling water supply to an inner loop manifold and an outer loop manifold which are both centrally located about at vertical axis of said tank to promote movement of settled particulate material toward an open unobstructed inlet of a jet pump and said jet pump being capable of aspirating through said unobstructed inlet, disturbed particulate material for transport of such material exterior of said tank;

ii) said means for sequential controlling of said water supply controlling supply of water to said inner manifold to promote flow of particulate material from a central area to said inlet; terminating supply of water to said inner manifold and supplying water to said outer manifold to promote flow of particulate material from an outer area toward said central area, terminating supply of water to said outer manifold and supplying water to said inner manifold to promote flow of particulate material which has been moved from said outer area toward said unobstructed inlet; and repeating said sequence of switching water supply from said inner manifold to said outer manifold as many times as needed to remove settled particulate material from said tank base; and iii) means for controlling flow rate and pressure to each of said manifolds to promote said flow of said particulate material without excessively or appreciably disturbing the upper fluid layers of crude oil and water.

2. A tank of claim 1, wherein an intermediate manifold is positioned between said inner and outer manifolds, said means for sequentially controlling water supply supplying water to said inner, intermediate and outer manifolds to promote flow of particulate material toward said unobstructed inlet.

* * * * *